US005793159A

United States Patent [19]

West et al.

[11] Patent Number: 5,793,159

[45] Date of Patent: Aug. 11, 1998

[54] LENSED END LAMP WITH CURVED FILAMENT FOR UNIFORM ILLUMINATION

[75] Inventors: Teresa Motz West, Skaneateles; William Henry Lagerway; Raymond Alan Dean, both of Auburn, all of N.Y.

[73] Assignee: Welch Allyn, Inc., Skaneateles Falls, N.Y.

[21] Appl. No.: 738,898

[22] Filed: Oct. 28, 1996

[51] Int. Cl.[6] ..... H01K 1/28; H01K 7/00

[52] U.S. Cl. ..... 313/580; 313/113; 313/271; 313/578; 313/315; 362/326; 362/255; 362/335

[58] Field of Search ..... 313/579, 580, 313/578, 279, 315, 317, 112, 271, 110, 113; 362/326, 335, 255

[56] References Cited

U.S. PATENT DOCUMENTS

| | | | |
|---|---|---|---|
| 2,228,342 | 1/1941 | Claude | 313/578 |
| 4,935,668 | 6/1990 | Hansler et al. | 313/112 |
| 5,508,587 | 4/1996 | Williams et al. | 313/578 |
| 5,515,123 | 5/1996 | Baldwin et al. | 362/335 |

*Primary Examiner*—Sandra L. O'Shea
*Assistant Examiner*—Joseph Williams
*Attorney, Agent, or Firm*—Wall Marjama & Bilinski

[57] ABSTRACT

A lamp which provides substantially uniform illumination over a predetermined area which includes a glass envelope having a lensed end and a curved filament contained within the envelope. The filament contains a plurality of coils which are disposed in a concave orientation with respect to the lensed end.

11 Claims, 4 Drawing Sheets

LENSED END LAMP WITH CURVED FILAMENT FOR UNIFORM ILLUMINATION

FIELD OF THE INVENTION

This invention relates generally to a lensed-end lamp, and more specifically, to a lamp which contains a curved filament.

BACKGROUND OF THE INVENTION

Most filaments in precision lamps are straight, mainly for ease of manufacturing. When used in an application where uniformity of illumination is important, the straight filament approach does not always satisfy this objective. The reasons for this failing is the following: A straight filament does not conform to the characteristic inward field curvature of simple imaging lenses used to collect and project the flux from the filament. Furthermore, the distance from the center of the filament to the imaging lens is shorter than the distance from the ends of the filament. This introduces a cosine intensity fall off at the projected image plane. In addition, the angles from the end coils to the imaging optics may exceed the critical angle and lead to total internal reflection losses within the lens system. A further problem is that in a straight filament the cross sectional area of the end coils of the filament is foreshortened as compared to the central coils, introducing another cosine loss.

It can therefore be seen from above that there is a need in the art for a lamp which can reliably provide uniform illumination over a predetermined area such as rectangular or oval when this objective is a requirement.

OBJECTS AND SUMMARY OF THE INVENTION

It is therefore an object of the present invention to provide a miniature lamp which provides for substantially uniform intensity over a predetermined area.

It is a further object of the invention to provide a lensed end lamp which utilizes a curved filament and exhibits uniform illumination.

It is a further object of the present invention to provide an improved miniature lamp which provides for uniform illumination and which overcomes the problems of the prior art described above.

The present invention is directed to a precision, miniature lensed end lamp having a curved filament, and which exhibits substantially uniform intensity or illumination over a predetermined area.

The filament which is curved, is disposed in a concave orientation to the imaging optics, and overcomes the shortcomings of the prior art described above. The curved profile of the filament generally conforms to the inherent field curvature of the imaging optics. The end coils are, therefore, substantially normal to the first surface of the imaging optics. In addition, the distance from each coil to the imaging optics is substantially equal. This lamp configuration exhibits uniform illumination over a predetermined area where such an application is an objective. In a preferred embodiment of the invention, the lens configuration is bi-convex (or equi-bi convex).

BRIEF DESCRIPTION OF THE DRAWINGS

For a fuller understanding of the nature and objects of the invention, reference should be made to the following detailed description of a preferred mode of practicing the invention, read in connection with the accompanying drawings, in which.

DETAILED DESCRIPTION OF THE INVENTION

Figure 1:
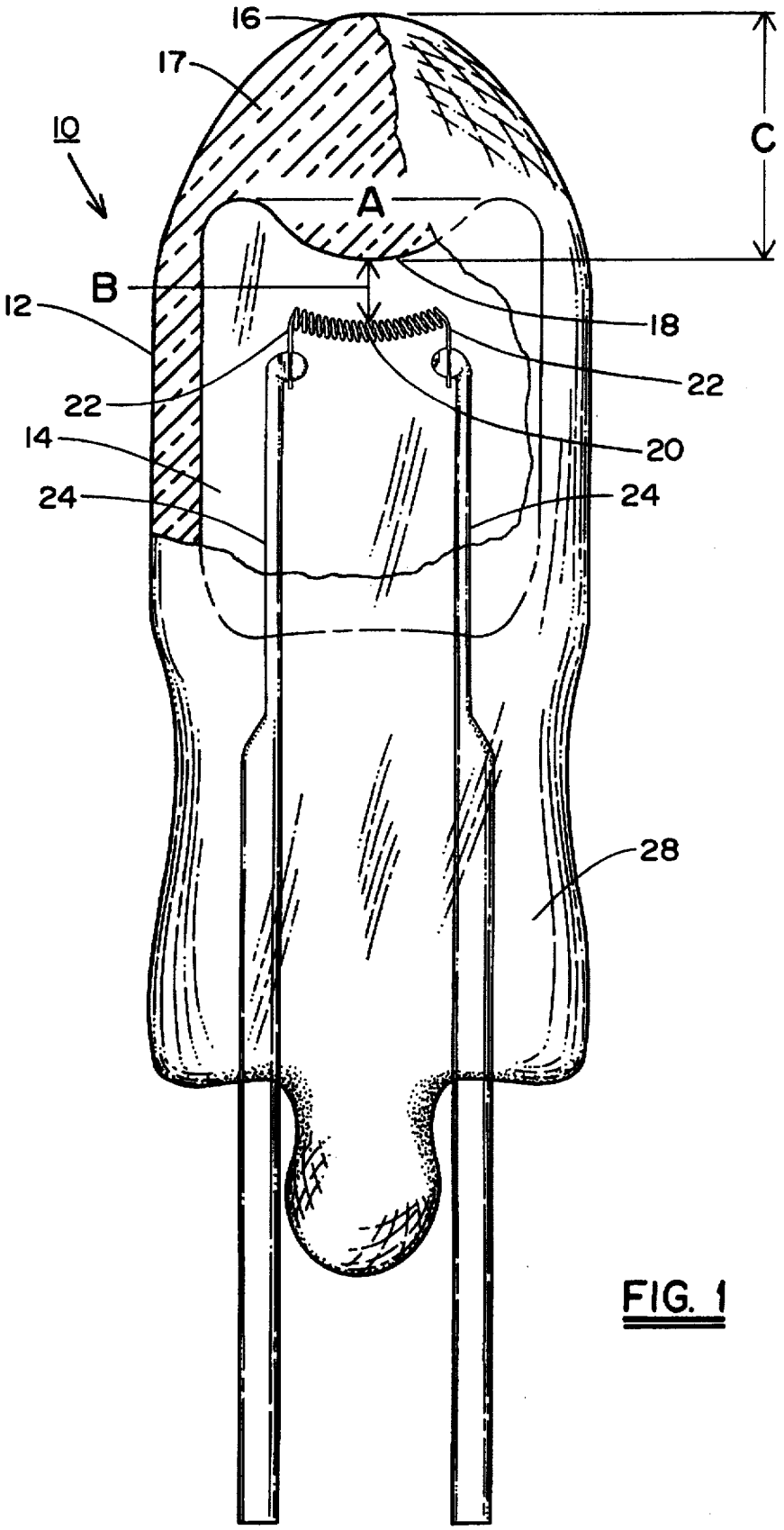
FIG. 1 is a partial sectional front view of a lamp made according to the present invention.

The present invention may be better understood with reference to the drawings, and in particular to FIG. 1 which illustrates an enlarged view of a preferred embodiment of the invention in the form of a bi-convex lensed lamp having a curved filament. In FIG. 1, lamp 10 contains an outer glass envelope 12 and filled inner chamber 14 which contains a curved filament 20 having a pair of filament legs 22 which are attached to filament supports 24. The lens 17 is bi-convex and contains convex surfaces 16 and 18, respectively.

Figure 2:
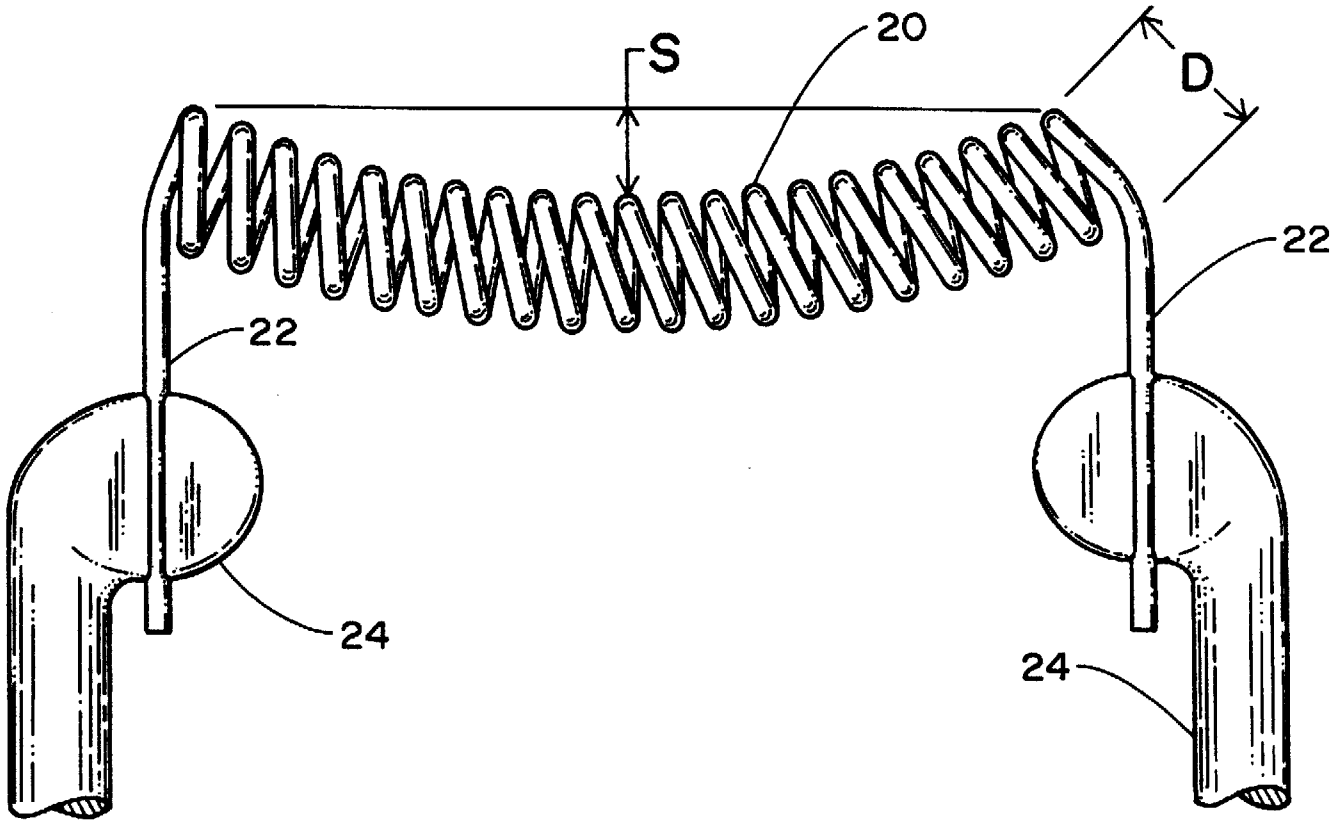
FIG. 2 is an enlarged view of the filament shown in FIG. 1.
Figure 3:
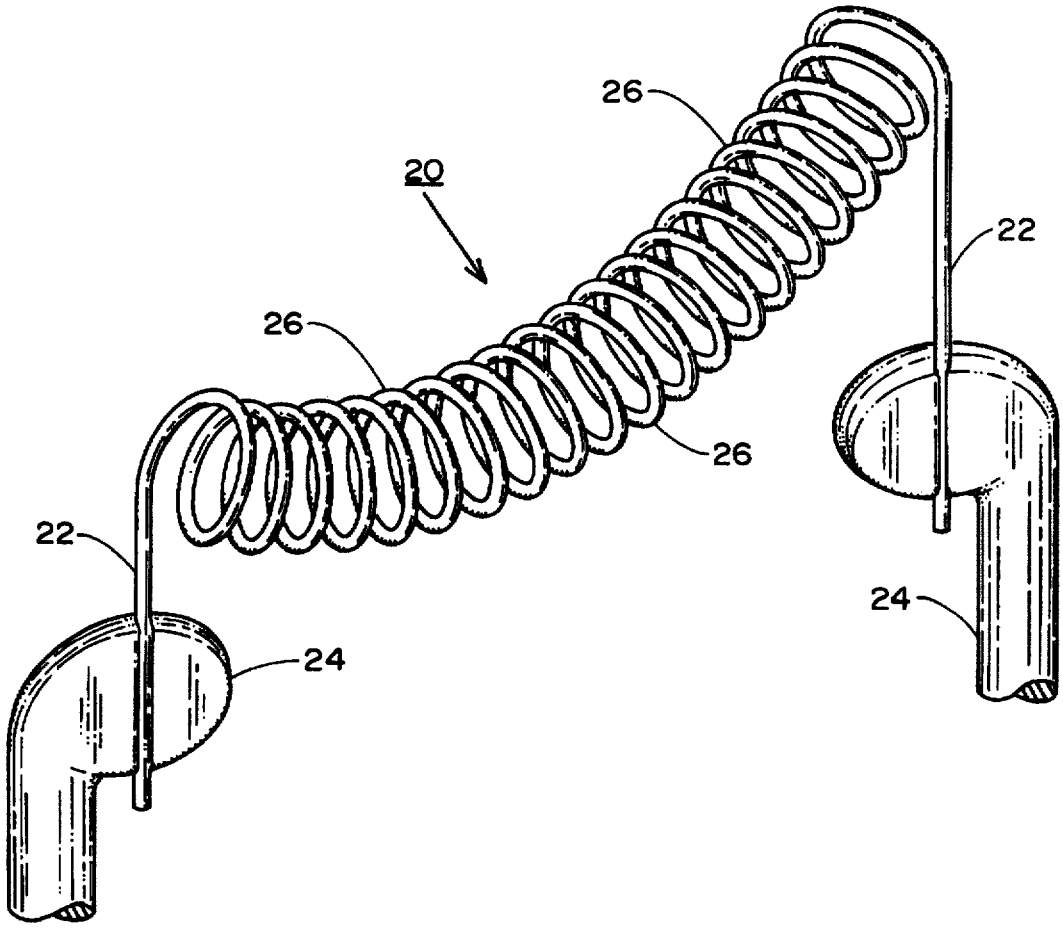
FIG. 3 is an enlarged perspective view of the filament shown in FIG. 1.

FIG. 2 illustrates an enlarged view of filament 20 showing in greater detail the attachment of filament legs 22 to filament supports 24. FIG. 3 is a perspective view of filament 20 which illustrates the curvature of the filament and the uniformity of the individual filament coils 26.

Generally, the focal length of the imaging lens can range from 2 to 5 mm for miniature lamps. It is dependent upon the filament length, lens working clear aperture and size of the area to be illuminated.

The filament length should be at least half of the working clear aperture of the lens. The shape of the curved filament should approximate the shape of the lens surface nearest the filament, with the sag of the filament (S in FIG. 2) typically being equal to the filament diameter (D in FIG. 2). Further bending leads to manufacturing problems.

The distance between the filament and the lens vertex should be about at least 25 percent to 50 percent of the lens focal length. The light emitted from the lamp is therefore diverging. The amount of divergence required is determined by the distance and dimensions of the area to be illuminated.

The curves of the lens can be spherical but the addition of a conic deformation constant has several advantages. The conic flattens the lens surfaces at the edges, allowing the lens thickness to be minimized. In addition, the conic helps minimize or eliminate the normally large spherical aberration present in non-aspheric lenses. Conic constants range from −0.25 to −1.5; higher values (more negative) distort the surface to the extent that it complicates lens fabrication.

The following parameters define a miniature lamp having the configuration illustrated in FIG. 1 and constitute a preferred embodiment of the present invention.

- Lens radius and conic of first surface: 1.805 mm & −0.8 (See 18, FIG. 1)
- Lens radius and conic of second surface: −1.805 mm & −1.1 (See 16, FIG. 1)
- Vertex lens thickness: 4 mm (distance C in FIG. 1)
- Working clear aperture: 4 mm (distance A in FIG. 1)
- Filament length: 2.4 mm
- Filament to lens distance: 1.1 to 1.2 mm (distance B in FIG. 1)
- Lens to area (2×12 mm rectangle) to be illuminated: 25 mm Filament Design The filament is designed within the constraints of the power provided. This design is a substantially 7.0 volt, 0.714 amps with 6.5 mean spherical candle power (MSCP). The method to design the power requirements of the filament is common knowledge to anyone familiar with the art of lamp making.

Filament

The filament consists of 20.5 turns of a 7.50 mg/200 mm filament wire weight wound on a 0.24 mm diameter smooth, straight mandrel. The wire is halogen grade tungsten (HG) obtained from Osram/Sylvania and manufactured to a +/−1% weight tolerance. The tungsten wire is wound on the mandrel at room temperature with legs left 1.27 to 1.91 mm long for supporting and attaching to the filament support wires. (The filament legs are left parallel to each other when viewed from the end of the filament). The filament is wound to 205 turns per inch which results in a total filament length of 2.54 mm. The filament OD is maintained at 0.36 mm. No heat treating is performed on the filaments after they are wound. (See FIG. 1.)

Filament Mounting

The filaments are attached to filament supports consisting of 0.25 mm dia molybdenum wire. The filament supports are positioned vertically with the upper ends (1.30 mm) formed 90 degrees inward. Each leg of the filament is placed against the horizontal portion of filament support with the distance between the bottom of the filament body and the top portion of the filament support held to 0.89 mm. The filament is attached by a swaging process where the softer molybdenum "flows" around the harder tungsten. The degree of the swag is determined by the strength of the bond. Additional bond strength is attained by applying more pressure during swaging. (See FIGS. 2 and 3.)

Filament Forming

The curvature in the filament is performed by applying downward pressure to the midpoint of the filament. The goal is to curve the filament so the upper diameter is offset 0.35–0.64 mm from its initial position. The filament will need forming beyond these values due to some spring back. Care is taken during forming to ensure the curvature is uniform and all filament coils maintain uniform pitch.

Glass Sealing and Filling

An envelope (see 12 of FIG. 1) consisting of Corning 1724 glass is used to enclose the environment around the filament. Lens 17 at the upper end of the envelope has a vertex thickness of 4 mm with the curvatures 16 and 18 formed to the proper radii. The envelope OD is maintained to 7.1 mm (see 12 of FIG. 1). Sealing techniques common to the industry are used to form the hermetic seal (see 28 of FIG. 1) between the filament support wires and glass envelope. An exhaust tube (not shown) is used between the filament support wires in the seal to provide a means of exhausting and filling the lamp. The air is evacuated and the lamp is backfilled with halogen gas then burned in using techniques common to the industry.

The lamp of the present invention as maintained above is suitable for providing uniform illumination within + or −10% over an area 2×12 mm at a distance of 25 mm. The present invention overcomes the illumination fall off at the extremes of the rectangular area characteristic of a straight filament. It should also be understood that different areas at different planes may be found with substantially similar aspect ratios. It should be understood that the present invention is not limited to the visible portion of the spectrum, but may have applications in the ultraviolet and infrared regions.

Figure 5:
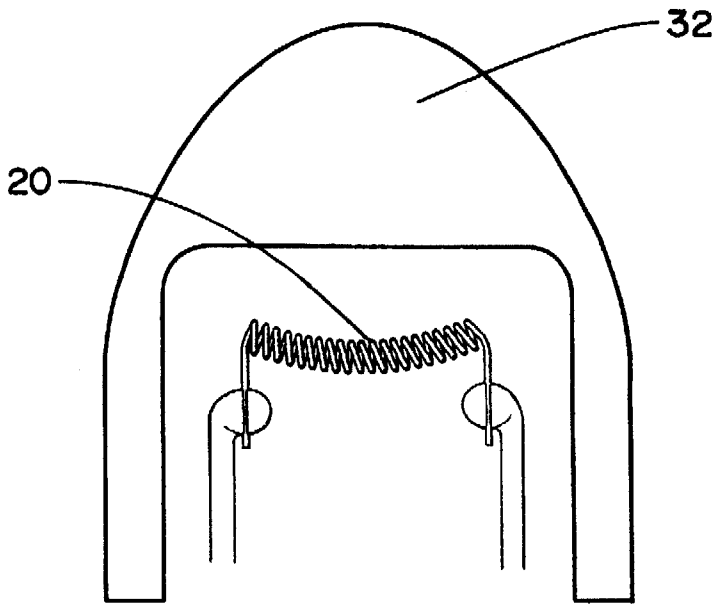
FIG. 5 is another embodiment of the invention in which the lens shape is plano-convex.
Figure 4:
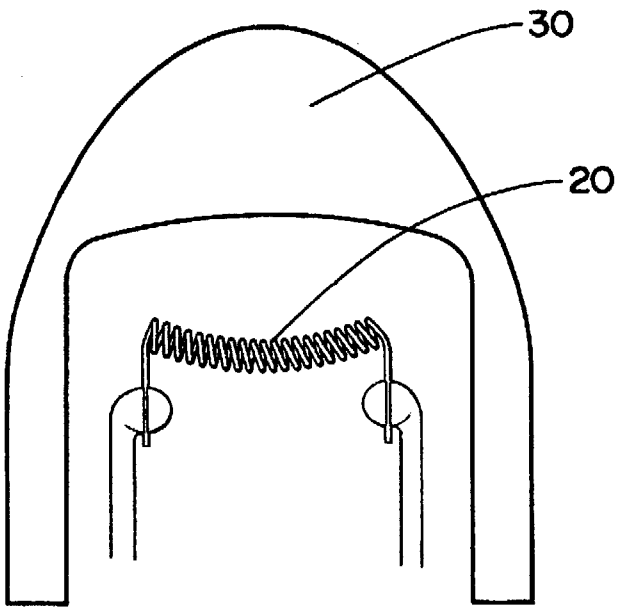
FIG. 4 is a further embodiment of the invention in which the lens shape is meniscus.

In a further embodiment as illustrated in FIGS. 4 and 5, the lens shape may be either meniscus 30 (one side convex, one side concave) (FIG. 4) or plano-convex 32 (FIG. 5). Although in these embodiments, the end coils of the filament are not normal to the first surface of the imaging optics or the same distance from each coil to the imaging optics they still provide a more uniform illumination than a straight filament.

The application of the present invention is especially useful in miniature and subminiature lamps having glass diameters up to about 16 mm.

While the present invention has been particularly shown and described with reference to the preferred mode as illustrated in the drawing, it will be understood by one skilled in the art that various changes in detail may be effected therein without departing from the spirit and scope of the invention as defined by the claims.

We claim:

1. A miniature lamp which comprises:

(a) a glass envelope having a bi-convex lensed end; and (b) a curved filament contained within said envelope, said filament containing a plurality of end and central coils and being disposed in a concave orientation with respect to said lensed end to provide a predetermined rectangular or oval area of substantially uniform illumination.

2. The lamp of claim 1 in which the lensed end configuration is biconvex.

3. The lamp of claim 1 in which the lensed end configuration is plano convex.

4. The lamp of claim 1 in which the lensed end is meniscus.

5. A lamp which provides substantially uniform illumination over a predetermined area which comprises:

(a) a glass envelope having a cylindrical sidewall up to about 16 mm in diameter and a lensed end;

(b) said lensed end being bi-convex in shape and defining a predetermined working clear aperture and having a focal length from about 2 to 5 mm, and (c) a curved filament contained within said envelope, said filament containing a plurality of turns and being disposed in a concave orientation with respect to said lensed end.

6. The lamp of claim 5 in which the filament length is at least half of the lens working clear aperture.

7. A miniature lamp which provides substantially uniform illumination over a predetermined area which comprises:

(a) a glass envelope having imaging optics in the form of a lensed end; and (b) a curved filament contained within said envelope, said filament containing a plurality of turns and being disposed in a concave orientation with respect to said lensed end, and where the curved profile of the filament generally conforms to the inherent field curvature of the imaging optics.

8. The lamp of claim 7 in which the lensed end is bi-convex in shape.

9. The lamp of claim 1 in which a curved profile of the filament generally conforms to an inherent field curvature of an imaging optics with the end coils being substantially normal to a first surface of the imaging optics.

10. The lamp of claim 1 in which a curved profile of the filament is such that the end coils of the filament are generally higher than the center coils by no more than the filament coil diameter and whose center is positioned from a lens vertex at about at least 25 percent to 50 percent of an integral lens focal length which is about 2 to 5 mm for miniature lamps.

11. The lamp of claim 10 where the curves of the integral lens may have conic constants from −0.25 to −1.5.

* * * * *